US010792581B2

(12) United States Patent
Cabibihan et al.

(10) Patent No.: US 10,792,581 B2
(45) Date of Patent: Oct. 6, 2020

(54) SMART ROBOTIC THERAPEUTIC LEARNING TOY

(71) Applicant: QATAR UNIVERSITY, Doha (QA)

(72) Inventors: John-John Cabibihan, Doha (QA); Hifza Javed, Doha (QA); Kishor Kumar Sadasivuni, Doha (QA); Ahmed Yaser Alhaddad, Doha (QA)

(73) Assignee: QATAR UNIVERSITY, Doha (QA)

( * ) Notice: Subject to any disclaimer, the term of this patent is extended or adjusted under 35 U.S.C. 154(b) by 0 days.

(21) Appl. No.: 16/326,169

(22) PCT Filed: Aug. 15, 2017

(86) PCT No.: PCT/IB2017/054967

§ 371 (c)(1),
(2) Date: Feb. 15, 2019

(87) PCT Pub. No.: WO2018/033857

PCT Pub. Date: Feb. 22, 2018

(65) Prior Publication Data

US 2019/0184299 A1 Jun. 20, 2019

Related U.S. Application Data

(60) Provisional application No. 62/375,138, filed on Aug. 15, 2016.

(51) Int. Cl.

| | |
|---|---|
| ***A63H 19/14*** | (2006.01) |
| ***A63H 19/15*** | (2006.01) |
| ***A63H 19/10*** | (2006.01) |

(52) U.S. Cl.

CPC ..... *A63H 19/14* (2013.01); *A63H 19/10* (2013.01); *A63H 19/15* (2013.01); *A63H 2200/00* (2013.01)

(58) Field of Classification Search

CPC ..... A63H 19/10; A63H 19/14; A63H 19/02; A63H 19/15; A63H 19/24; A63H 19/36; A63H 19/00; A63H 33/28; A63H 33/3044

See application file for complete search history.

(56) References Cited

U.S. PATENT DOCUMENTS 1,849,877 A * 3/1932 Lyons ..... A63H 17/002 105/238.2
2,675,641 A * 4/1954 Baggott ..... A63H 33/28 446/18

(Continued)

FOREIGN PATENT DOCUMENTS

CN 102218219 A 10/2011
CN 102872598 A 1/2013

(Continued)

OTHER PUBLICATIONS

International Search Report and Written Opinion issued in corresponding International Patent Application No. PCT/IB2017/054967 dated Dec. 5, 2017.

(Continued)

*Primary Examiner* — Eugene L Kim
*Assistant Examiner* — Alyssa M Hylinski
(74) *Attorney, Agent, or Firm* — Squire Patton Boggs (US) LLP

(57) ABSTRACT

Certain embodiments may generally relate to smart robotic therapeutic devices. A modular toy may include a multiple detachable carriages. The modular toy may also include a liquid crystal display (LCD) screen mounted on a first carriage of the plurality of carriages. The modular toy may further include a bubble-generation mechanism installed on the first carriage, a container disposed on a second carriage of the plurality of carriages that is attached to the first carriage, and a robotic arm mounted on a third carriage of (Continued)

the plurality of carriages that is attached to the second carriage.

15 Claims, 9 Drawing Sheets

(56) References Cited

U.S. PATENT DOCUMENTS

| | | | | |
|---|---|---|---|---|
| 3,264,782 | A * | 8/1966 | Glass | A63H 17/006 446/435 |
| 4,367,608 | A * | 1/1983 | Melotti | A63H 33/28 446/20 |
| 4,813,905 | A * | 3/1989 | Yamaguchi | A63H 17/28 362/35 |
| 5,395,274 | A * | 3/1995 | Myers | A63H 33/28 446/16 |
| 6,457,681 | B1 * | 10/2002 | Wolf | A63H 19/14 104/296 |
| 7,770,847 | B1 * | 8/2010 | Severson | A63H 19/24 246/1 C |
| 7,926,427 | B1 * | 4/2011 | Ricks | B61G 7/14 105/1.5 |
| 8,154,227 | B1 * | 4/2012 | Young | A63H 30/04 318/255 |
| 2003/0051631 | A1 * | 3/2003 | Ring | A63H 19/24 105/1.5 |
| 2003/0172834 | A1 | 9/2003 | De-Gol | |
| 2005/0053909 | A1 * | 3/2005 | Chan | A63H 30/00 434/365 |
| 2014/0179197 | A1 * | 6/2014 | Bradley | A63H 3/28 446/297 |
| 2014/0360399 | A1 * | 12/2014 | Rees | A63H 19/24 104/295 |

FOREIGN PATENT DOCUMENTS

| | | | | |
|---|---|---|---|---|
| CN | 103764236 | A | 4/2014 | |
| CN | 205360589 | U | 7/2016 | |
| GB | 2186199 | A * | 8/1987 | A63H 33/28 |

OTHER PUBLICATIONS

Chinese Office Action issued in corresponding Chinese Patent Application No. 201780049953.9 dated May 27, 2020.

* cited by examiner

SMART ROBOTIC THERAPEUTIC LEARNING TOY

FIELD OF THE INVENTION

The present invention generally relates to smart robotic therapeutic learning toys. More specifically, the present invention generally relates to a smart robotic therapeutic learning toy train and methods for addressing various conditions in children, including, for example, Autism Spectrum Disorder (ASD).

BACKGROUND OF THE INVENTION

Children with special needs vary widely in the nature and degree of their skills, abilities and difficulties. Consequently, their special needs exhibit the same diversity, encompassing educational, social, behavioral, learning, and physical needs. Such children are often observed to be quiet, aloof, and withdrawn into a world of their own. They are unable to make sense of their environment or understand instructions, and often have difficulty in developing and maintaining social relationships. In addition, a large number suffer from anxiety and depression as direct consequences of their conditions.

Some of the children with special needs have a condition known as Autism Spectrum Disorder (ASD). In general, ASD is a neurodevelopment disorder, usually diagnosed during the first 3 years of life. It may be accompanied by other physical or psychological disorders, and is traditionally characterized by impairments in social communication, social interaction, and imagination abilities. Further, ASD is often attributed to an absence of the mentalizing ability in a person diagnosed with autism, and is a complex developmental disability that has a large variety of manifestations.

According to the Centers for Disease Control and Prevention (CDC) report in 2014, about 1% of the world's population has ASD. ASD has become more prevalent in countries around the world. In the United Kingdom for example, about one child out of 100 children have ASD. In the United States, the autism prevalence rate is about 1 in 48 births, and in South Korea, it is about 1 in 38.

In Qatar, there has been reported on average over 220 new referrals each year for ASD assessment and intervention. Thirty percent of those children are Qataris, and boys represent 80% of the cases. To put these numbers in perspective, the State of Qatar has a population of 2.35 million and 13.7% (approx. 321,950) of these are children under 14 years old. The demand for autism support from local and expatriate communities has been rising in the country. From only 4 special needs centers in the 1992-2003 period, there has been about a 250% increase in the number of centers in the succeeding years up to the present.

In Qatar, the total economic cost of mental disorders is estimated at $470 million per annum. For example, Child Development Center (CDC), a special needs center in Doha, Qatar, offers a five-day-a-week full-time program currently costs $5,550 a month. In the US, the cost of autism over the lifespan is about $2.4 million for a person with an intellectual disability, or $1.4 million for a person without an intellectual disability.

There is a need, therefore, for improved healthcare and educational facilities for children with ASD. There is also a need to improve the standard of facilities currently available to address the special needs of these children. There is a further need to offer affordable intervention and support services that do not have to be limited to therapy sessions inside clinics, but can be made ubiquitous with easily manageable use at home by parents as well.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

Figure 1:
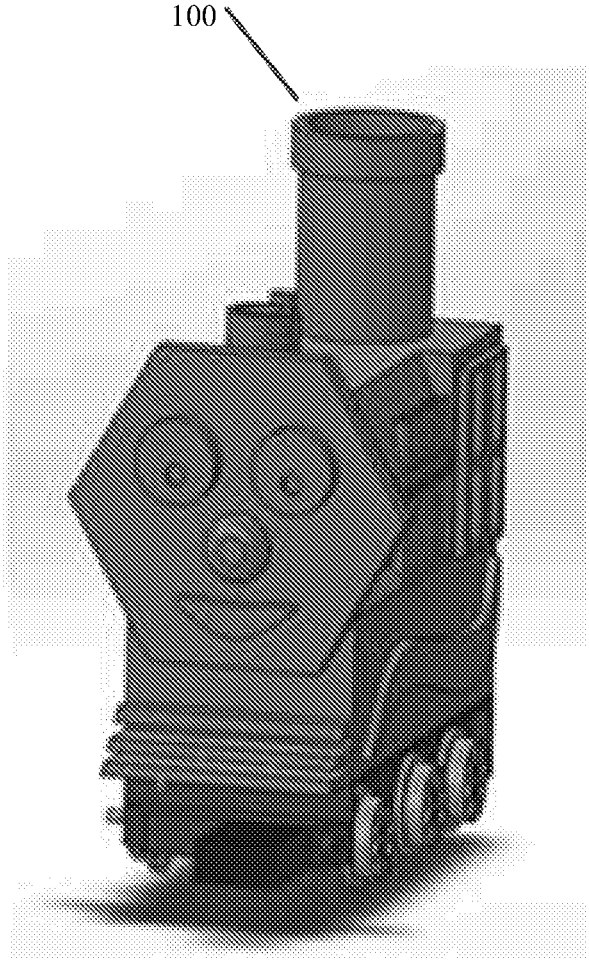
FIG. 1 illustrates a model of a robotic train according to certain embodiments.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical or structural changes may be made to the invention without departing from the spirit or scope of this disclosure. To avoid detail not necessary to enable those skilled in the art to practice the embodiments described herein, the description may omit certain information known to those skilled in the art. The following detailed description is, therefore, not to be taken in a limiting sense.

DETAILED DESCRIPTION OF THE INVENTION

The features, structures, or characteristics of the invention described throughout this specification may be combined in any suitable manner in one or more embodiments. For example, the usage of the phrases "certain embodiments," "some embodiments," or other similar language, throughout this specification refers to the fact that a particular feature, structure, or characteristic described in connection with the embodiment may be included in at least one embodiment of the present invention.

Over the years, studies have shown that children on the Autism Spectrum Disorder (ASD) take a liking to interactive robotic toys. While human interactions are complex, requiring simultaneous processing of information flowing in from numerous channels, such as speech, facial expressions, gestures, body language etc., interactions with robots are greatly simplified. Communication with robots is limited to short, simple dialog, and basic gestures and emotions, which offers much lower chances of sensory overstimulation for these children. Such robots are now used extensively, aimed at eliciting novel social behaviors and encouraging engagement.

A large number of accounts have been recorded from around the world confirming a deep bond between children diagnosed with ASD and toy trains. There have been investigations on the reasons for this popularity to determine how a train can be used as an effective form factor for social robots in ASD intervention. Certain embodiments described herein explore the plausibility of a train as a form factor among kids with ASD based on their reactions, interaction durations, and engagement speed with the toy inn comparison with the humanoid robots.

There may be several reasons why toy trains are of great popularity among children with ASD, and why they can be an effective form factor for an ASD intervention tool. One reason may be that trains in general have been known to have a wide appeal for individuals on the autism spectrum. Trains often come with schedules. This is in line with such children's need for predictability and patterns that help them make sense of the world around them.

Another reason may be that trains come with details. Such toys help fulfill the inclination to memorize details such as model, color, size etc., and recite them from memory. This also satisfies the children's need to collect, identify, and organize things into categories, serving as a tool for cognitive development. Such children have been observed to enjoy lining up their trains, arranging them according to color and numbers. Parents often use this as a tool to teach numbers and counting. The distinctive, bold colors grab the child's attention and help maintain longer engagements. They also help distinguish and identify the different characters, and develop an understanding of colors.

According to another reason, trains have wheels. This draws immense interest from children whose sensory interests include watching spinning/rotating/moving objects, which is common among children on the autism spectrum. This also has the added advantage of encouraging motor skills while indulging in play with these toys, which are often a challenge for such children.

A further reason may be that trains fall, crash, and smash against each other. Children with autism have been observed to enjoy reenacting crashing scenes from videos because the action is clear and easy to follow. This improves their otherwise limited imitation skills. Trains can also become a cause-and-effect toy, yielding reactions dependent upon the actions of the child. This helps them develop a perception of their environment and their role in it.

According to another reason, trains come with tracks of varying lengths and layouts. Each track may be set in a different landscape, ranging from caves, dinosaur lands and farms, to avalanches and many more. The diversity in sceneries implies a variety in the pieces used to form the terrain features. Not only do these children get to learn more about the world around them, but also gain plenty from the physical manipulation involved in building these tracks with their parents or playmates.

There may be different methods and/or simulations to treat ASD. According to certain embodiments, a toy train may be designed to address the needs of children with unusual feeding problems, emotional difficulties, communication problems, and weak motor skills. Certain embodiments may provide improvements upon the available toys for special needs children, especially for children on the autism spectrum, who have been reported to show a strong affinity toy trains.

Referring to FIG. 1, there is shown a model of a robotic train 100 according to certain embodiments. The robotic train 100 may be capable of offering a wide range of applications with its technologically advanced features. To ensure the safety of use by children with ASD, the train 100 may be made of a soft material. For example, the train 100 may be made of silicone, or other similar material, in order to ensure safety of use by children with ASD who may be susceptible to aggressive or self-injurious behaviors. According to certain embodiments, the train 100 may be of a single carriage, or in other embodiments, may include more than one carriage. As shown in FIG. 1, according to certain embodiments, the train 100 may also have a fixed face and a chimney equipped with a bubble generation mechanism.

Various embodiments, for example, may provide a therapeutic and learning tool that can be used by therapists and parents to address a number of conditions in children with special needs, such as children with ASD. Although some embodiments may be directed to an approach to a subset of the possible uses, other embodiments may be applicable toward those with ASD. For instance, certain embodiments may implement a smart robotic device, such as a toy train for children or other devices, with technologically advanced features that can help children with ASD or other conditions overcome some of the difficulties they face.

According to certain embodiments, the train may be specifically designed to address the needs of children with unusual feeding problems, emotional difficulties, communication problems, and weak motor skills. In certain embodiments, the train may be dynamic, to which pieces can be removed or added to include more functionality, thus broadening the scope of applications to include other special needs as well, even those not included in the autism spectrum. In certain embodiments, the train pieces may be made colorful to enhance their appeal to children.

In other embodiments, the train may also come with a variety of tracks. These tracks may include a fixed track and/or a light-emitting diode (LED) track that is projected onto the floor in real-time along a path of the train. The train may also be programmed to follow different paths along which the LED track will be projected in real-time, allowing the train to bypass any restriction in its motion. In addition to these, other embodiments may have capabilities of implementing certain software applications that can be downloaded onto hardware of the train by connecting the train to a software application store, which can enable the train to play games and conduct a variety of interactive activities with the children.

In certain embodiments, the train may have the potential for health and social impact. For example, the train may be targeted at children with ASD, but may also cater to children outside of the autism spectrum, including those with special needs such as weak motor skills or obesity, learning impairments, deficiencies in emotional understanding, as well as unusual feeding problems. Thus, according to certain embodiments, the target users of the toy train may include children on the autism spectrum, meaning that its targeted application may be its use in ASD intervention by therapists and parents. In other embodiments, the toy train may include extra features that may also be incorporated into the train to improve the physical interactions between the children and the train, and to speed up the engagement with the toy.

Figure 2:
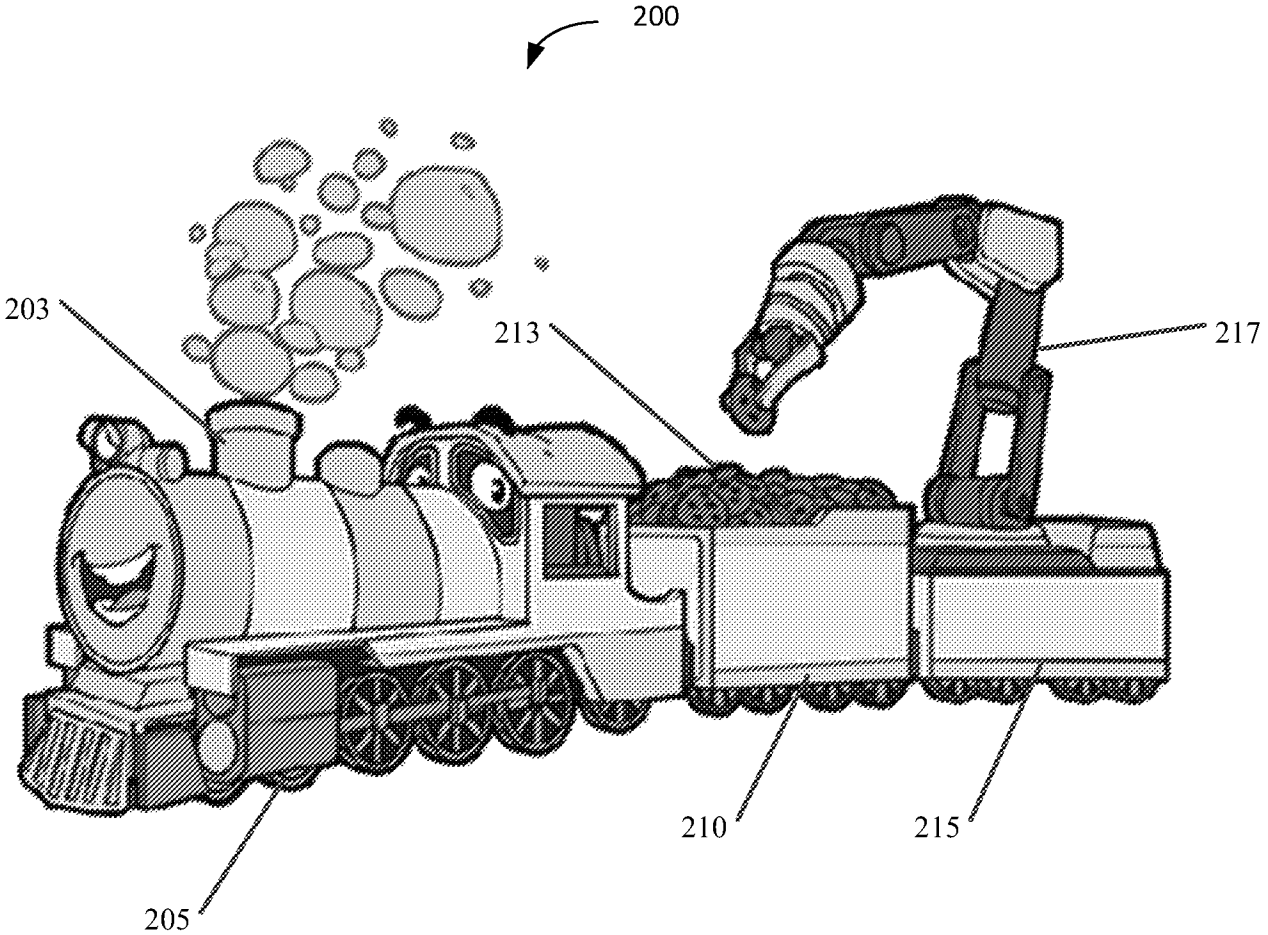
FIG. 2 illustrates another model of the robotic train according to certain embodiments.

Referring to FIG. 2, there is shown another model of a robotic train 200 according to certain embodiments. As shown in FIG. 2, the train 200 may be modular. That is, the train 200 may be formed by combining multiple, detachable carriages together. In come embodiments, the train 200 may include three carriages, but additional pieces may be appended to widen the scope of applications of the train.

In FIG. 2, the first carriage 205 of the train 200 may include an engine that displays a face of a train character. This may be achieved using one or more liquid crystal display (LCD) screens, which make the train 200 capable of exhibiting a set of basic facial expressions. The first carriage 205 may also include a chimney 203, fitted with a bubble-generation mechanism, which generates bubbles to emulate the smoke produced by a real steam engine. The first carriage 205 may further include an opening at its back from where coal is fed to the engine.

As further shown in FIG. 2, a second carriage 210 may be added and connected to the first carriage 205. The second carriage 210 may include a container holding toy pieces of coal 213 on which the train 200 runs. Further, a third carriage 215 may be added to the first and second carriages. The third carriage may include a robotic arm 217 that picks up the coal 213 from the second carriage 210 and feeds it to the first carriage 205.

According to certain embodiments, the robotic arm 217 may have a total of five joints including the base. In certain embodiments, the base rotation may be up to about a 180 degree rotation, while the rest of the joints may be up to about 120 degrees.

Figure 3:
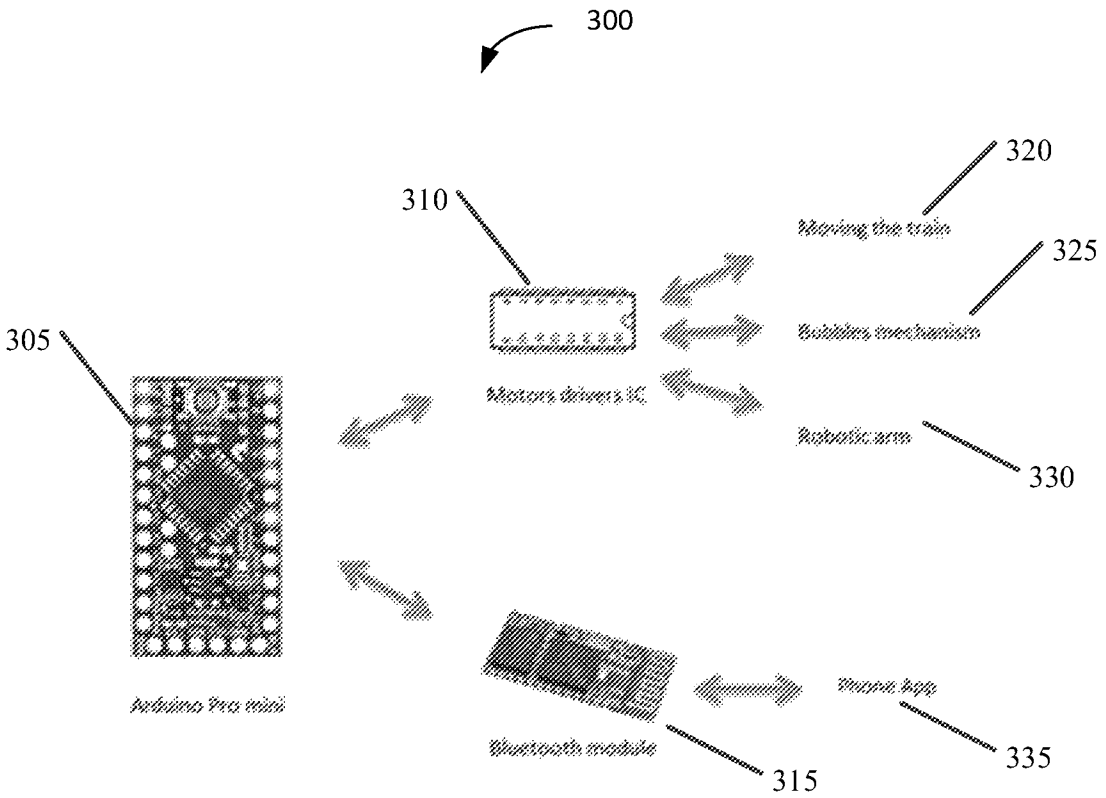
FIG. 3 illustrates an overview of system components according to certain embodiments.

Referring to FIG. 3, there is shown an overview of system components 300 according to certain embodiments. The hardware shown in FIG. 3 may be incorporated into the train, and the hardware may be accompanied by software applications that are downloadable to the train set from an Internet application store. Each application may be developed to carry out a particular activity via the train with a child, intended to extract a desired result. This allows the robot to become suitable for use by therapists in clinics, as well as by parents at home.

Although FIG. 3 illustrates a system of components according to certain embodiments, in other embodiments, additional hardware and software may be incorporated. New hardware pieces may be added to the initial three-piece set to cater to a larger number of needs. These can be accompanied with respective software applications with finer details to better achieve target results.

In the train system 300 of FIG. 3, there may be included a programmable microcontroller 305 that allows for the train to be controlled by a wireless and/or mobile device, such as a smart phone or multimedia device, a computer, such as a tablet, provided with wireless communication capabilities, personal data or digital assistant (PDA) provided with wireless communication capabilities, portable media player, or any combinations thereof. Due to its small size and low-power consumption, in an embodiment, an Arduino® Pro Mini microcontroller board may be selected as a candidate for the toy train. The microcontroller 305 may have sufficient digital and analog pins to interface and control with the hardware needed for the toy.

The train system 300 may also include at least one or more motor driver integrated circuits (ICs) 310. This ICs 310 may be interfaced to three different motor sub-systems. The first set of motors 320 may be in charge of controlling the movement of the train. The second set of motors 325 may be in control of the bubble-generation mechanism to release bubbles from the train. Finally, the third set of servo motors 330 may be used to activate and control the robotic arm. According to certain embodiments, each set of motors may be separate and individually controlled via receiving commands from the microcontroller 305. The microcontroller 305 may also be interfaced serially to a Bluetooth® module 315 in which it allows establishing a wireless communication between the microcontroller 305 and an external device, such as a wireless and/or mobile device described above. The toy, via the microcontroller 305, may also be controlled through an open-source application such as a smart phone software application 335, or any other software application for any one of the wireless and/or mobile devices described above. In doing so, pairing between the microcontroller 305 and the wireless and/or mobile device may be performed to establish the connection between the application 335 and the microcontroller 305.

According to certain embodiments, the train may be equipped with a projector that can be configured, via the microcontroller 305, to project an LED track in real-time along the path of the train, and equipped with an LCD device or screen that can display a variety of images or videos. The LED track may be changeable and set in any of a variety of desired paths for the train to move. According to such a configuration, the microcontroller 305 may be programmed to implement a variety of games and/or activities that can target certain special needs of children including, for example, weak motor skills, difficulties in emotion recognition, and feeding problems.

According to certain embodiments, the train, via the microcontroller 305, may be programmed to implement a "chase-and-follow" game. Such a game may help improve motor skills of children. This type of game may be designed to activate the projector to project an LED track in real-time along the path of the train, which will not limit the train's movements to a fixed track. This will also allow the train to move freely along a random path in a room or outdoors, urging the child to follow it. Receiving encouragement directly from the train adds to the already appealing prospect of chasing a moving toy, which helps to motivate the child and eventually improve his or her motor skills.

According to other embodiments, the train, via the microcontroller 305, may be programmed to implement a "guess the emotion" game. The capability of emotional expression can be utilized to design emotion recognition games. With the LCDs, a face of the train can be given the capability to express a set of basic emotions, such as anger, happiness, excitement, sadness, and various other emotions. Further, an interactive guessing game can be developed whereby the train may ask the child to guess the emotion being displayed. For every correct response, the child may be rewarded, and for every incorrect response, the child may be urged to guess again until he or she reaches the correct answer.

According to certain embodiments, the train, via the microcontroller 305, may be programmed to implement a "feeding by implementation" game. Imitation has been extensively used by therapists to teach a variety of skills to children with ASD. Feeding problems in such children may be addressed by encouraging the child to imitate the train. The train may "eat" the coal (food) through a robotic arm (spoon/fork), in order to get the "energy" to move around again. This scenario may be used to encourage food intake in children with feeding problems by imitating the train. The train can also, via the microcontroller, be programmed to indulge in encouraging dialog during the course of this activity to urge the child to eat the food.

According to other embodiments, the train, via the microcontroller 305, may be programmed to implement a "reward mechanism" game. It is important for a child with autism to know that a certain action from him or her will yield a favorable response from the robot. Therapists take advantage of this factor to extract positive behaviors from the child. Several rewarding mechanisms may be possible with this design. For example, in certain embodiments, the train may provide encouragement through dialog with the child. A clapping/cheering background sound may also be used in all of the above activities, generated by the train after the child successfully executes an instruction. In addition to these are the bubbles, which have been reportedly used by many therapists to encourage children on the autism spectrum during therapy sessions. Certain embodiments may also incorporate this useful mechanism into a single tool, eliminating the need to use bubble guns or blowers separately. These bubbles may not only be used after successful completion of a task by a child, but also to improve their focus and enhance their level of engagement during therapy.

Figure 4:
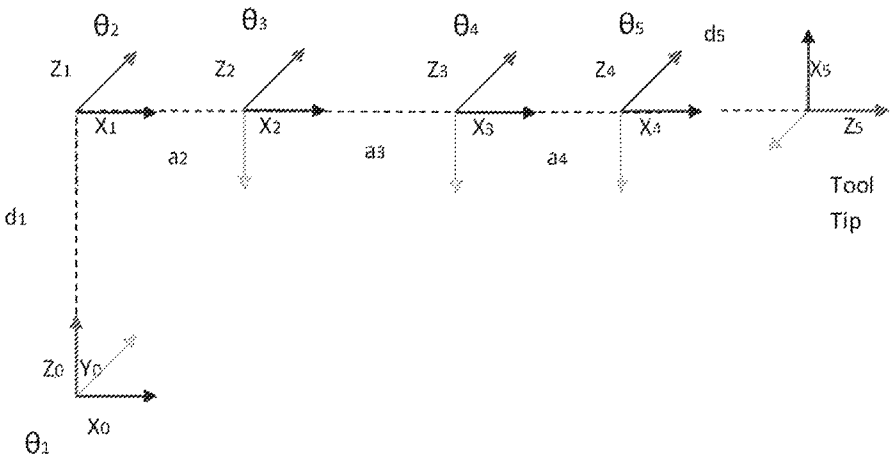
FIG. 4 illustrates a coordinate frame for a robotic arm according to certain embodiments.

Referring to FIG. 4, there is shown, according to certain embodiments, a coordinate frame for the robotic arm. The coordinates include corresponding kinematic parameter values shown in Table I below.

TABLE 1

| Axis | θ | d | a | α |
|---|---|---|---|---|
| 1 | θ1 | d1 | 0 | −90 |
| 2 | θ2 | 0 | a2 | 0 |
| 3 | θ3 | 0 | a3 | 0 |
| 4 | θ4 | 0 | a4 | 0 |
| 5 | θ5 | d5 | 0 | −90 |

In certain embodiments, the values of the kinematic parameters may be subjected to change. The overall transformation matrix of the inverse kinematic may follow the following generalized form:

$$\text{Total motion} = (\text{Arm motion})(\text{Wrist Motion})$$

$$T_{base}^{Tool} = T_{base}^{Wrist} + T_{Wrist}^{Tool}$$

$$T_{base}^{Tool} = \begin{bmatrix} \text{Overall Rotation matrix} & \text{Overall Position matrix} \\ 0\ 0\ 0 & 1 \end{bmatrix}$$

Figure 5:
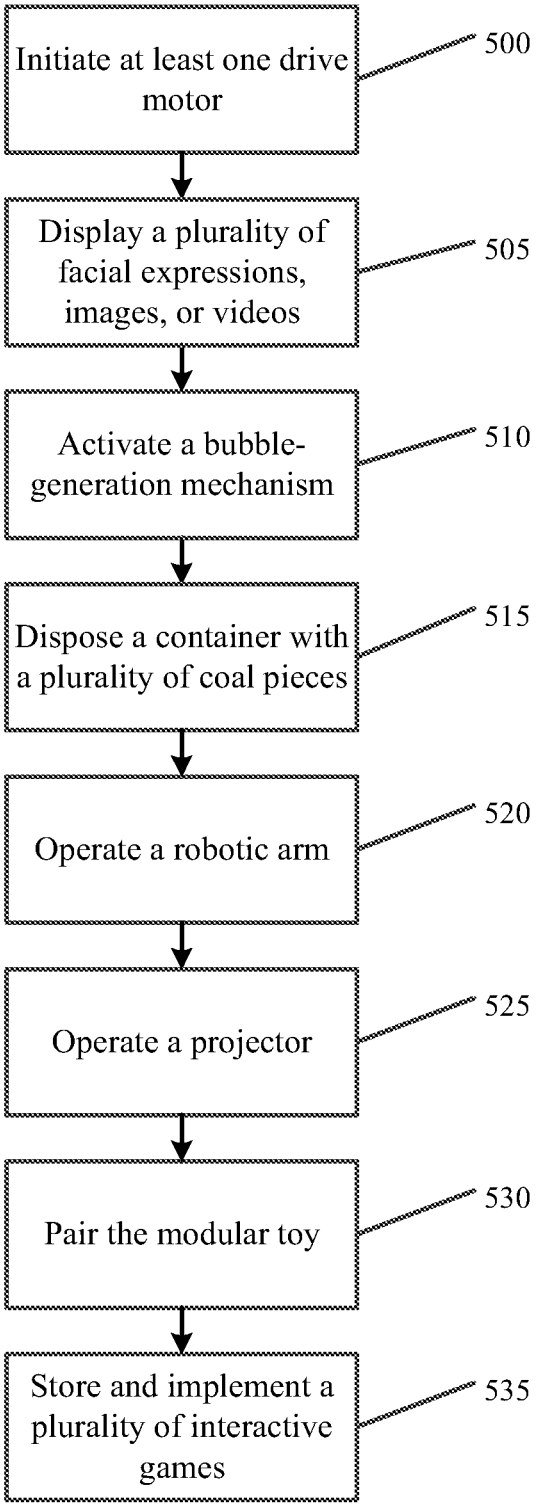
FIG. 5 illustrates a flow diagram according to certain embodiments.

Referring to FIG. 5, there is shown a flow diagram according to certain embodiments. In certain embodiments, the toy train may be configured to operate via a microcontroller to perform various functions. For example, at step 500, operation of the train may include initiating at least one drive motor to place the train in motion by a drive motor driver IC interconnected with a microcontroller. The direction and path for which the train travels may be configurable accordingly as desired by an operator. At step 505, operation of the train may include displaying, with an LCD screen, a plurality of configurable facial expressions, images, or videos from a first carriage of the train. According to certain embodiments, the facial expressions, images, or videos may be configurable accordingly as desired by an operator.

At step 510, operation of the train may include activating a bubble-generation mechanism that is driven by a separate motor by a motor driver IC interconnected with a microcontroller. At step 515, operation of the train may include disposing a container that may include a plurality of coal pieces, onto a second carriage of the train. At step 520, operation of the train may include operating a robotic arm mounted on a third carriage of the train to interact with the first carriage and the second carriage. In certain embodiments, operation of the robotic arm may also include operating the robotic arm to pick up the plurality of coal pieces from the second carriage and feeding the plurality of coal pieces to the first carriage.

At step 525, operation of the train may include operating a projector installed on the first carriage of the train to project a track in real-time along a path of the train. At step 530, operation of the train may include pairing the train with a portable device, and operating the train while the portable device is paired with the train. At step 535, operation of the train may include storing into the train and implementing at least one of a plurality of interactive games. In certain embodiments, the plurality of interactive games may be configured to elicit an external response and cause the train to perform an action based on the external response.

Figure 6:
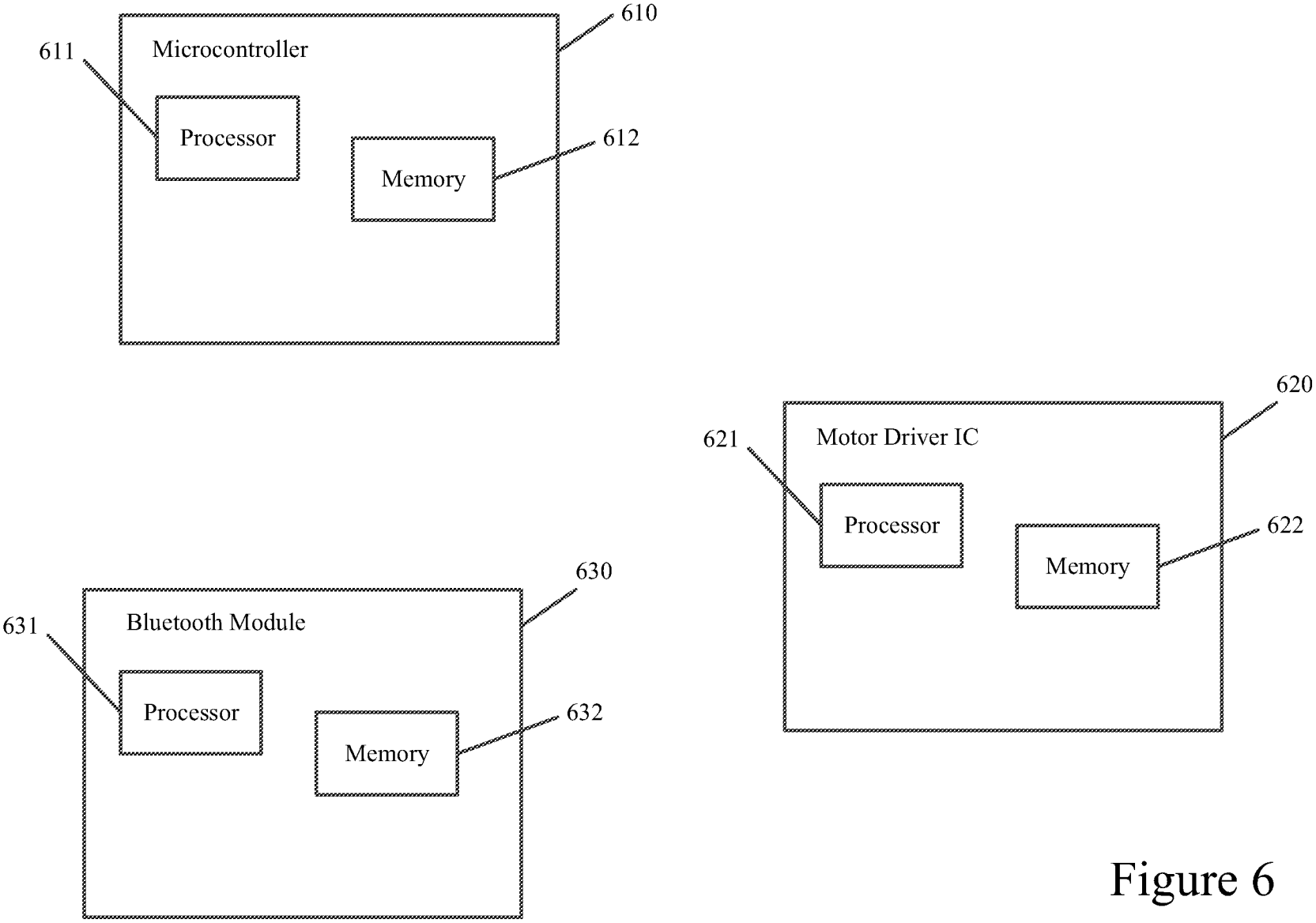
FIG. 6 illustrates a system according to certain embodiments.

Referring to FIG. 6, there is shown a system according to certain embodiments. It should be understood that each of FIGS. 1 through 5 may be implemented by various means of their combinations, such as hardware, software, firmware, one or more processors and/or circuitry. In one embodiment, a system may include several devices, such as, for example, microcontroller 610, motor driver IC, or Bluetooth module 630. The system may include more than one microcontroller 610, motor drive IC 620, and Bluetooth module 630, although only one of each of these devices are shown in FIG. 6 for the purposes of illustration.

Each of the devices shown in FIG. 6 may include at least one processor or control unit or module, respectively indicated as 611, 621, and 631. At least one memory may be provided in each device, and indicated as 612, 622, and 632, respectively. The memory may include computer program instructions or computer code contained therein. Other configurations of these devices, for example, may be provided. In certain embodiments, the microcontroller may an Arduino Pro Mini microcontroller, the motor driver IC may be an L293 motor driver, and the Bluetooth module may be an HC-05 Bluetooth module.

Processors 611, 621, and 631 may be embodied by any computational or data processing device, such as a central processing unit (CPU), digital signal processor (DSP), application specific integrated circuit (ASIC), programmable logic devices (PLDs), field programmable gate arrays (FPGAs), digitally enhanced circuits, or comparable device or a combination thereof. The processors may be implemented as a single controller, or a plurality of controllers or processors.

For firmware or software, the implementation may include modules or unit of at least one chip set (for example, procedures, functions, and so on). Memories 612, 622, and 632 may independently be any suitable storage device, such as a non-transitory computer-readable medium. A hard disk drive (HDD), random access memory (RAM), flash memory, or other suitable memory may be used. The memories may be combined on a single integrated circuit as the processor, or may be separate therefrom. Furthermore, the computer program instructions may be stored in the memory and which may be processed by the processors can be any suitable form of computer program code, for example, a compiled or interpreted computer program written in any suitable programming language. The memory or data storage entity is typically internal but may also be external or a combination thereof, such as in the case when additional memory capacity is obtained from a service provider. The memory may be fixed or removable.

The memory and the computer program instructions may be configured, with the processor for the particular device, to cause a hardware apparatus such as microcontroller 610, motor driver IC 620, or Bluetooth module 630, to perform any of the processes described above, including, for example, at least those shown in FIGS. 3 and 5. Therefore, in certain embodiments, a non-transitory computer-readable medium may be encoded with computer instructions or one or more computer program (such as added or updated software routine, applet or macro) that, when executed in hardware, may perform a process such as any one of the processes described herein. Computer programs may be coded by a programming language, which may be a high-level programming language, such as objective-C, C, C++, C#, Java, etc., or a low-level programming language, such as a machine language, or assembler. Alternatively, certain embodiments may be performed entirely in hardware.

Several experiments were conducted using toy trains, such as Thomas the Tank Engine® trains. In Experiment 1, three Thomas the Tank Engine trains were used that included two blue Thomas trains of different sizes and one red Percy train. These were used against a considerably larger, multi-colored toy train.

Figure 7:
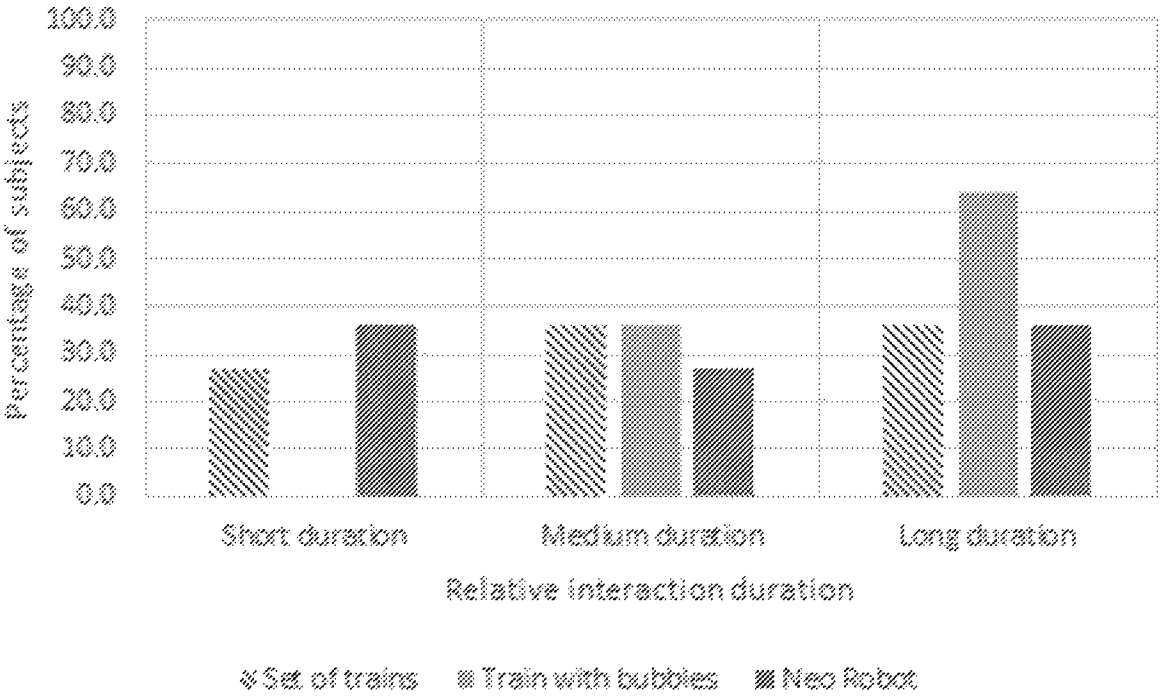
FIG. 7 illustrates a bar chart of an interaction duration of three toy groups measured relative to an experiment duration.

For Experiment 2, a train identical to the multicolored train from Experiment 1 was used, which had an additional feature that it generated bubbles from its chimney when powered on. In Experiment 3, two interactive social robots were used. One was Nao®, a popular Humanoid robot from Aldebaran, and the other was a very life-like seal robot from PARO® Robots. These stimuli are shown in FIG. 7. Specifically, FIG. 7 shows the interaction duration of the three toy groups measured relative to the experiment duration. The interaction durations were measured relative to the duration of the experiment and are as follows: Short less than 50%, Medium 50% to less than 75%, and Long was 75% and higher.

Figure 8:
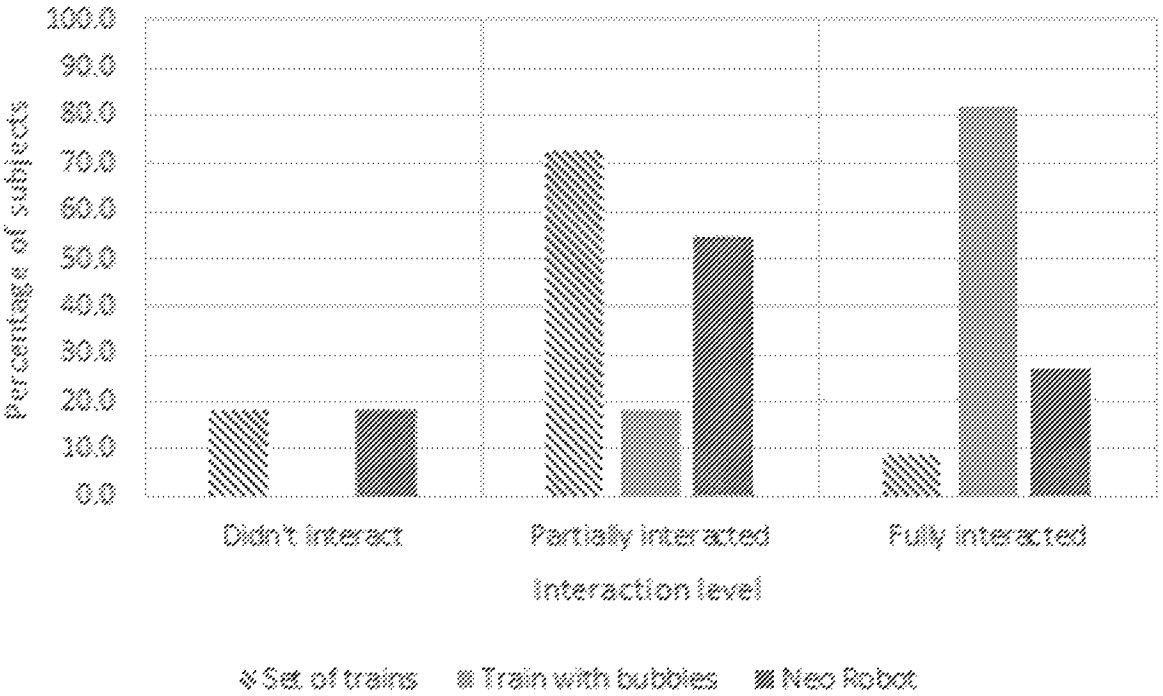
FIG. 8 illustrates a bar chart of a level of interaction between children and a group of toys.

In the three experiments, certain monitoring equipment was used. The children's interactions were monitored with video cameras in the four corners of the room, and the results obtained from the monitoring are shown in FIG. 8. Specifically, FIG. 8 shows the level of interaction between the children and the group of toys. Not interacting includes those who either refused to engage with the toy or ignore it during the experiments. Partial interaction includes semi-discontinuous and semi-excited interactions, and full interaction involves a high level of engagement with the toys and noticeable excitement.

In the monitoring, the cameras were positioned to ensure that the children's activities were captured from different angles to allow for free play and movement. The network cameras automatically stored the recorded videos on the cloud from where it could be later downloaded for processing. Live viewing was also available through the D-Link D-ViewCam software. Care was taken in equipment selection and its setup to ensure that it remained unobtrusive throughout the length of the experiments.

Figure 9:
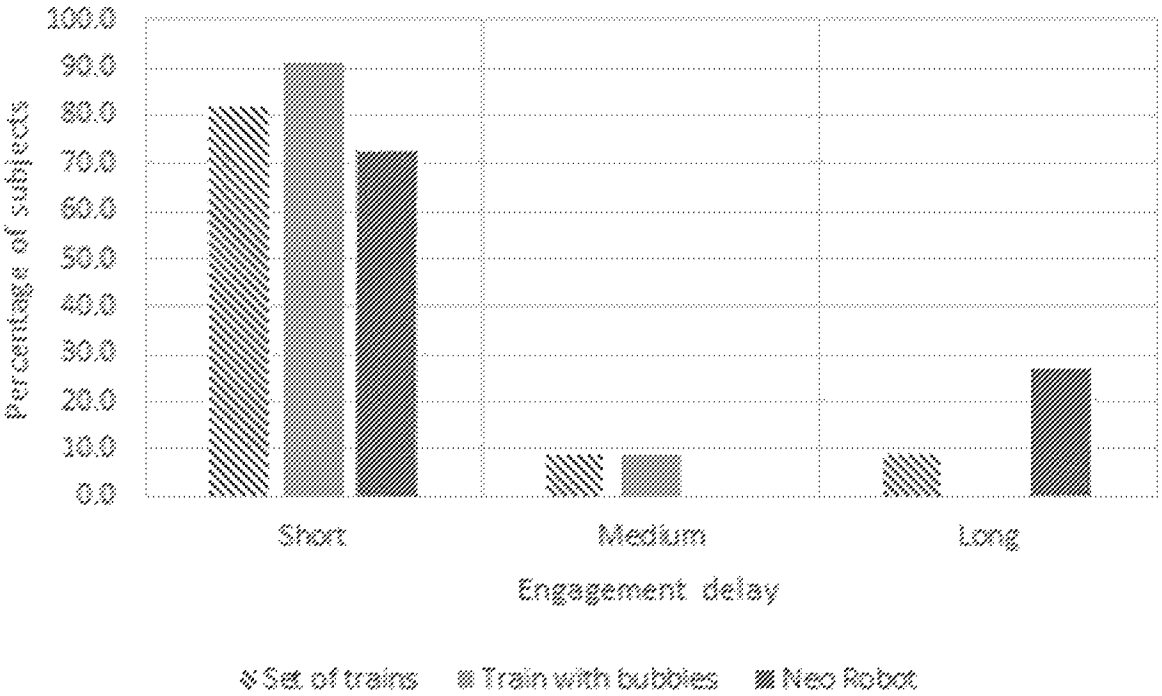
FIG. 9 illustrates a bar chart of an engagement delay measured with respect to elapsed time between introducing a toy and a first observed reaction.

For a thorough and reliable analysis, the children were also required to wear an Empatica® E4 wristband, which recorded the children's Electrodermal Activity (EDA), motion, body temperature, and Blood Volume Pulse (BVP). The data gathered from this wristband are shown in FIG. 9. Specifically, FIG. 9 shows an engagement delay measured as the time elapsed between introducing the toy and the first observed reaction. The engagement delays were as follows: Short was less than 30s, Medium was higher than 30s and less than 1 min, and Long was greater than 1 min that also included no interaction cases.

The physiological data gathered provide an insight into the internal state of the wearer, which prevents the interaction analysis from being based solely on visible evidence, and takes the internal state into account. The session data was uploaded to the cloud automatically after the end of each session for post-processing. The data was also made available in real-time through a smartphone application.

Example embodiments of the invention may provide several technical improvements. According to certain embodiments, the toy train may be used by typically developing children, enabling it to become a general consumption product that can be made available in markets, instead of limiting their use to clinics. In other embodiments, the train appeals not only to ASD children but also to children with a range of disabilities and impairments outside of the autism spectrum.

Though many commercial healthcare toys are currently available in the market, the toy therapeutic train as shown in FIGS. 1 and 2, for example, has several advantages over them. For example, the toy may be more cost effective than other robotic tools available for ASD intervention. Other robotic tools are more complex and far more expensive, and require technical expertise to be handled effectively. However, the toy according to certain embodiments has the potential to enhance its effectiveness as an intervention and learning tool.

The train according to other embodiments may be a simple and well programmed alternative, to which additional functionality can simply be downloaded by parents and therapists without any prior technical knowledge. The train robot according to certain embodiments may also be easily made available in the market as a general consumption toy. Other embodiments of the toy may incorporate human-like features, such as a face that can express emotions, and the ability to talk etc. The train according to other embodiments, may further be compatible with research works based on social robots for ASD, and incorporate technological advanced robotic features by being programmable, being capable of interacting with external mobile devices, and being able to implement various software applications, each application being developed to carry out a particular activity with a child, intended to extract a desired result.

Further, according to certain embodiments, the train design as a form factor carries an immense potential for health and social impact. It may be targeted at children with ASD, but also caters to children outside of the autism spectrum, with special needs such as weak motor skills or obesity, learning impairments, deficiencies in emotional understanding, as well as unusual feeding problems. Certain embodiments may also improve the physical interaction and speed up the engagement with the toy.

Although the foregoing description is directed to the preferred embodiments of the invention, it is noted that other variation and modifications will be apparent to those skilled in the art, and may be made without departing from the spirit or scope of the invention. Moreover, features described in connection with one embodiment of the invention may be used in conjunction with other embodiments, even if not explicitly stated above.

According to a first embodiment, a modular toy may include a plurality of detachable carriages. The modular toy may also include a liquid crystal display (LCD) screen mounted on a first carriage of the plurality of carriages. The modular toy may further include a container disposed on a second carriage of the plurality of carriages that is attached to the first carriage. The modular toy may also include a robotic arm mounted on a third carriage of the plurality of carriages that is attached to the second carriage.

In a variant, the LCD screen may be configured to display a plurality of facial expressions, images, or videos. In another variant, the bubble-generation mechanism may be configured to generate bubbles. In yet another variant, the container of the second carriage may include a plurality of coal pieces, and the first carriage may include an opening that faces a front portion of the second carriage.

In a variant, the robotic arm may be configured to pick up the coal pieces from the second carriage and feed the coal pieces to the first carriage through the opening of the first carriage. In another variant, the first carriage may include a chimney that is fitted with the bubble-generation mechanism. In yet another variant, the modular toy may include a projector, and the projector may be installed onto the first carriage and may be configured to project a track in real-time along a path of the modular toy.

According to a second embodiment, a method of operating a modular toy may include initiating at least one drive motor to place the modular toy in motion. The method may also include displaying, with a liquid crystal display (LCD) screen, a plurality of facial expressions, images, or videos from a first carriage of the modular toy. The method may further include activating a bubble-generation mechanism that is installed on the first carriage to generate bubbles. The method may also include disposing a container comprising a plurality of coal pieces onto a second carriage of the modular toy. The method may further include operating a robotic arm mounted on a third carriage of the modular toy to interact with the first carriage and the second carriage.

In a variant, the method may include operating the robotic arm to pick up the plurality of coal pieces from the second carriage and feeding the plurality of coal pieces to the first carriage. In another variant, the method may include operating a projector installed on the first carriage to project a track in real-time along a path of the modular toy. In yet another variant, the method may include pairing the modular toy with a portable device, and operating the modular toy while the portable device is paired to the modular toy.

In a variant, the method may include storing a plurality of interactive games into the modular toy, and implementing at least one of the plurality of interactive games, wherein the plurality of interactive games may be configured to elicit an external response and cause the modular train to perform an action based on the external response.

According to a third embodiment, a microcontroller may include at least one processor, and at least one memory including computer program code. The at least one memory and the computer program code may be configured to, with the at least one processor, cause the microcontroller at least to initiate at least one drive motor to place a modular toy in motion. The at least one memory and the computer program code may also be configured to, with the at least one processor, cause the microcontroller at least to display, with a liquid crystal display (LCD) screen, a plurality of facial expressions, images, or videos from a first carriage of the modular toy. The at least one memory and the computer program code may further be configured to, with the at least one processor, cause the microcontroller at least to activate a bubble-generation mechanism that is installed on the first carriage to generate bubbles. The at least one memory and the computer program code may also be configured to, with the at least one processor, cause the microcontroller at least to dispose a container comprising a plurality of coal pieces onto a second carriage of the modular toy. The at least one memory and the computer program code may further be configured to, with the at least one processor, cause the microcontroller at least to operate a robotic arm mounted on a third carriage of the modular toy to interact with the first carriage and the second carriage.

In a variant, the at least one memory and the computer program code may be configured to, with the at least one processor, cause the microcontroller at least to operate the robotic arm to pick up the plurality of coal pieces from the second carriage and feed the plurality of coal pieces to the first carriage. In another variant, the at least one memory and the computer program code may be configured to, with the at least one processor, cause the microcontroller at least to operate a projector installed on the first carriage to project a track in real-time along a path of the modular toy. In yet another variant, the at least one memory and the computer program code may be configured to, with the at least one processor, cause the microcontroller at least to pair the modular toy with a portable device, and operate the modular toy while the portable device is paired to the modular toy.

In a variant, the at least one memory and the computer program code may be configured to, with the at least one processor, cause the microcontroller at least to store at least one of a plurality of interactive games into the modular toy, execute at least one of the plurality of interactive games, elicit an external response during execution of at least one of the plurality of interactive games, and cause the modular toy to perform an action based on the external response.

We claim:

1. A modular toy, comprising:

a plurality of detachable carriages;

a liquid crystal display (LCD) screen mounted on a first carriage of the plurality of carriages;

a bubble-generation mechanism installed on the first carriage;

a container disposed on a second carriage of the plurality of carriages that is attached to the first carriage; and a robotic arm mounted on a third carriage of the plurality of carriages that is attached to the second carriage, wherein the robotic arm comprises a set of controllable motors that are interfaced with a motor driver integrated circuit electrically connected to a microcontroller in the modular toy, and wherein the microcontroller is wirelessly connected to a device external to the modular toy to provide control functions to operate the bubble-generation mechanism, to operate the robotic arm, and to move the modular toy.

2. The modular toy according to claim 1, wherein the LCD screen is configured to display a plurality of facial expressions, images, or videos.

3. The modular toy according to claim 1, wherein the bubble-generation mechanism is configured to generate bubbles.

4. The modular toy according to claim 1, wherein the container of the second carriage comprises a plurality of coal pieces, and wherein the first carriage comprises an opening that faces a front portion of the second carriage.

5. The modular toy according to claim 4, wherein the robotic arm is configured to pick up the coal pieces from the second carriage and feed the coal pieces to the first carriage through the opening of the first carriage.

6. The modular toy according to claim 1, wherein the first carriage comprises a chimney that is fitted with the bubble-generation mechanism.

7. The modular toy according to claim 1, further comprising a projector, the projector installed onto the first carriage and is configured to project a track in real-time along a path of the modular toy.

8. A method of operating a modular toy, comprising:

initiating at least one drive motor to place the modular toy in motion;

displaying, with a liquid crystal display (LCD) screen, a plurality of facial expressions, images, or videos from a first carriage of the modular toy;

activating a bubble-generation mechanism that is installed on the first carriage to generate bubbles;

disposing a container comprising a plurality of coal pieces onto a second carriage of the modular toy;

operating a robotic arm mounted on a third carriage of the modular toy to interact with the first carriage and the second carriage; and providing control functions to operate the bubble-generation mechanism, to operate the robotic arm, and to move the modular toy, wherein the control functions are provided via a microcontroller in the modular toy, the microcontroller being wirelessly connected to a device external to the modular toy, and wherein the robotic arm is operated via a set of controllable motors disposed therein that are interfaced with a motor driver integrated circuit electrically connected to the microcontroller.

9. The method of operating the modular toy according to claim 8, wherein the method further comprises operating the robotic arm to pick up the plurality of coal pieces from the second carriage and feeding the plurality of coal pieces to the first carriage.

10. The method of operating the modular toy according to claim 8, further comprising operating a projector installed on the first carriage to project a track in real-time along a path of the modular toy.

11. The method of operating the modular toy according to claim 8, further comprising:

storing at least one of a plurality of interactive games into the modular toy; and implementing at least one of the plurality of interactive games, wherein the plurality of interactive games are configured to elicit an external response and cause the modular train to perform an action based on the external response.

12. A microcontroller, comprising:

at least one processor; and at least one memory including computer program code, wherein the at least one memory and the computer program code are configured to, with the at least one processor, cause the microcontroller at least to initiate at least one drive motor to place a modular toy in motion;

display, with a liquid crystal display (LCD) screen, a plurality of facial expressions, images, or videos from a first carriage of the modular toy;

activate a bubble-generation mechanism that is installed on the first carriage to generate bubbles;

operate a robotic arm mounted on a third carriage of the modular toy to interact with the first carriage and a second carriage of the modular toy, and feed a plurality of coal pieces from the second carriage into the first carriage; and control functions of the bubble-generation mechanism, operation of the robotic arm, and movement of the modular toy via a wireless connection with a device external to the modular toy, wherein operation of the robotic arm is performed via a set of controllable motors disposed therein that are interfaced with a motor driver integrated circuit electrically connected to the microcontroller.

13. The microcontroller according to claim 12, wherein the at least one memory and the computer program code are further configured to, with the at least one processor, cause the microcontroller at least to operate the robotic arm to pick up the plurality of coal pieces from the second carriage and feed the plurality of coal pieces to the first carriage.

14. The microcontroller according to claim 12, wherein the at least one memory and the computer program code are further configured to, with the at least one processor, cause the microcontroller at least to operate a projector installed on the first carriage to project a track in real-time along a path of the modular toy.

15. The microcontroller according to claim 12, wherein the at least one memory and the computer program code are further configured to, with the at least one processor, cause the microcontroller at least to store at least one of a plurality of interactive games into the modular toy; and execute at least one of the plurality of interactive games, elicit an external response during execution of at least one of the plurality of interactive games, and cause the modular toy to perform an action based on the external response.

* * * * *